US011191992B1

(12) United States Patent
Grace

(10) Patent No.: US 11,191,992 B1
(45) Date of Patent: Dec. 7, 2021

(54) ANTIMICROBIAL WEIGHT LIFTING PLATES

(71) Applicant: Grace Premier Fitness & Wellness Products, Inc, Vancouver, WA (US)

(72) Inventor: Thomas Willson Grace, Vancouver, WA (US)

( * ) Notice: Subject to any disclaimer, the term of this patent is extended or adjusted under 35 U.S.C. 154(b) by 19 days.

(21) Appl. No.: 16/403,035

(22) Filed: May 3, 2019

Related U.S. Application Data

(60) Provisional application No. 62/668,143, filed on May 7, 2018.

(51) Int. Cl.
*A63B 21/072* (2006.01)
*C22C 9/06* (2006.01)
*A63B 21/00* (2006.01)

(52) U.S. Cl.
CPC ..... *A63B 21/072* (2013.01); *A63B 21/4035* (2015.10); *C22C 9/06* (2013.01); *A63B 2209/00* (2013.01)

(58) Field of Classification Search
CPC ..... A63B 21/072; A63B 21/4035; A63B 21/06–0608; A63B 21/72–783; A63B 2209/00; A63B 2244/09; C22C 9/06
See application file for complete search history.

(56) References Cited

U.S. PATENT DOCUMENTS 6,319,176 B1 * 11/2001 Landfair ..... A63B 21/06 482/106
8,172,734 B2 * 5/2012 Anderson ..... A63B 21/072 482/108
9,381,392 B2 * 7/2016 Behle ..... A63B 21/0728
10,537,777 B1 * 1/2020 Tash ..... A63B 65/10
2007/0072753 A1 * 3/2007 Ong ..... A61L 2/238 482/148

(Continued)

OTHER PUBLICATIONS

Ibrahim, Zina et al., "Reduction of bacterial burden by copper alloys on high-touch athletic center surfaces," published Oct. 25, 2017 by American Journal of Infection Control, vol. 46, pp. 197-201, retrieved from the Internet: https://www.ajicjournal.org/article/S0196-6553(17)31008-8/abstract (Year: 2017).*

*Primary Examiner* — Megan Anderson
*Assistant Examiner* — Kathleen Vermillera
(74) *Attorney, Agent, or Firm* — Rylander & Associates, PC; Philip R. M. Hunt

(57) ABSTRACT

Embodiments of antimicrobial weight plates with an antimicrobial copper alloy, preferably a cuprous nickel alloy, preferably the alloy contains approximately 91% copper and approximately 9% nickel. A first embodiment having a core weight plate and one or more weight plate handles coupled in a circumferential edge of the core weight plate, the weight plate handles with antimicrobial grip surfaces are each formed from the antimicrobial copper alloy. A second embodiment having a core weight plate in a shape of an annular disk formed from an antimicrobial copper alloy. A third embodiment having an antimicrobial weight plate including two antimicrobial weight plate surfaces, each including the antimicrobial copper alloy, and a core weight plate sandwiched between the two antimicrobial weight plate surfaces. A fourth embodiment having a core weight plate, and an antimicrobial copper alloy coating thermally sprayed on to the core weight plate.

2 Claims, 5 Drawing Sheets

(56) References Cited

U.S. PATENT DOCUMENTS

| | | | | |
|---|---|---|---|---|
| 2007/0179031 | A1* | 8/2007 | Chang | A63B 21/0607<br>482/108 |
| 2009/0156367 | A1* | 6/2009 | Harris, Jr. | A63B 21/055<br>482/49 |
| 2009/0247369 | A1* | 10/2009 | Chang | A63B 21/06<br>482/49 |
| 2010/0292054 | A1* | 11/2010 | Karpus | A63B 21/0004<br>482/122 |
| 2016/0138150 | A1* | 5/2016 | Pershin | A01N 59/16<br>427/455 |

* cited by examiner

ANTIMICROBIAL WEIGHT LIFTING PLATES

CROSS-REFERENCE TO RELATED APPLICATION

This application claims the benefit of U.S. Provisional Application No. 62/668,143, filed 7-MAY-2018, incorporated herein by reference.

TECHNICAL FIELD

This specification relates to strength training exercise equipment. More particularly, the present specification relates to strength training equipment with antimicrobial properties.

BACKGROUND

Strength training equipment includes barbells, dumbbells, kettlebells and strength-training machines. As is known to those of ordinary skill in the art, a barbell is an apparatus used in strength training, including a bar with disk-shaped weights detachably coupled to the ends.

Fitness facilities are often faced with outbreaks of dangerous and potentially deadly staph and MSRA infections. Outbreaks in high school and college locker rooms, professional sports training facilities and physical therapy centers have been documented. Fitness equipment such as barbell handles and the gripping surfaces of strength-training machines provide ideal breeding grounds for harmful bacteria that can easily spread among users, particularly since they often neglect to clean equipment after use.

BRIEF DESCRIPTION OF THE DRAWINGS

The accompanying drawings, which are incorporated into and constitute a part of this specification, illustrate one or more embodiments of the inventive subject matter and, together with the detailed description, serve to explain the principles and implementations thereof. Like reference numbers and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

DETAILED DESCRIPTION

In describing the one or more representative embodiments of the inventive subject matter, use of directional terms such as "upper," "lower," "above," "below", "in front of," "behind," etc., unless otherwise stated, are intended to describe the positions and/or orientations of various components relative to one another as shown in the various Figures and are not intended to impose limitations on any position and/or orientation of any component relative to any reference point external to the Figures.

In the interest of clarity, not all of the routine features of representative embodiments of the inventive subject matter described herein are shown and described. It will, of course, be appreciated that in the development of any such actual implementation, numerous implementation-specific decisions must be made in order to achieve specific goals, such as compliance with application and business-related constraints, and that these specific goals will vary from one implementation to another and from one developer to another. Those skilled in the art will recognize that numerous modifications and changes may be made to the representative embodiment(s) without departing from the scope of the claims. It will, of course, be understood that modifications of the representative embodiments will be apparent to those skilled in the art, some being apparent only after study, others being matters of routine mechanical, chemical and electronic design. No single feature, function or property of the representative embodiments is essential. In addition to the embodiments described, other embodiments of the inventive subject matter are possible, their specific designs depending upon the particular application. Any embodiment described as "comprising" includes the case of "consisting only of." The scope of the inventive subject matter should not be limited by the particular embodiments herein described but should be defined only by the appended claims and equivalents thereof.

First Representative Embodiment

Figure 1:
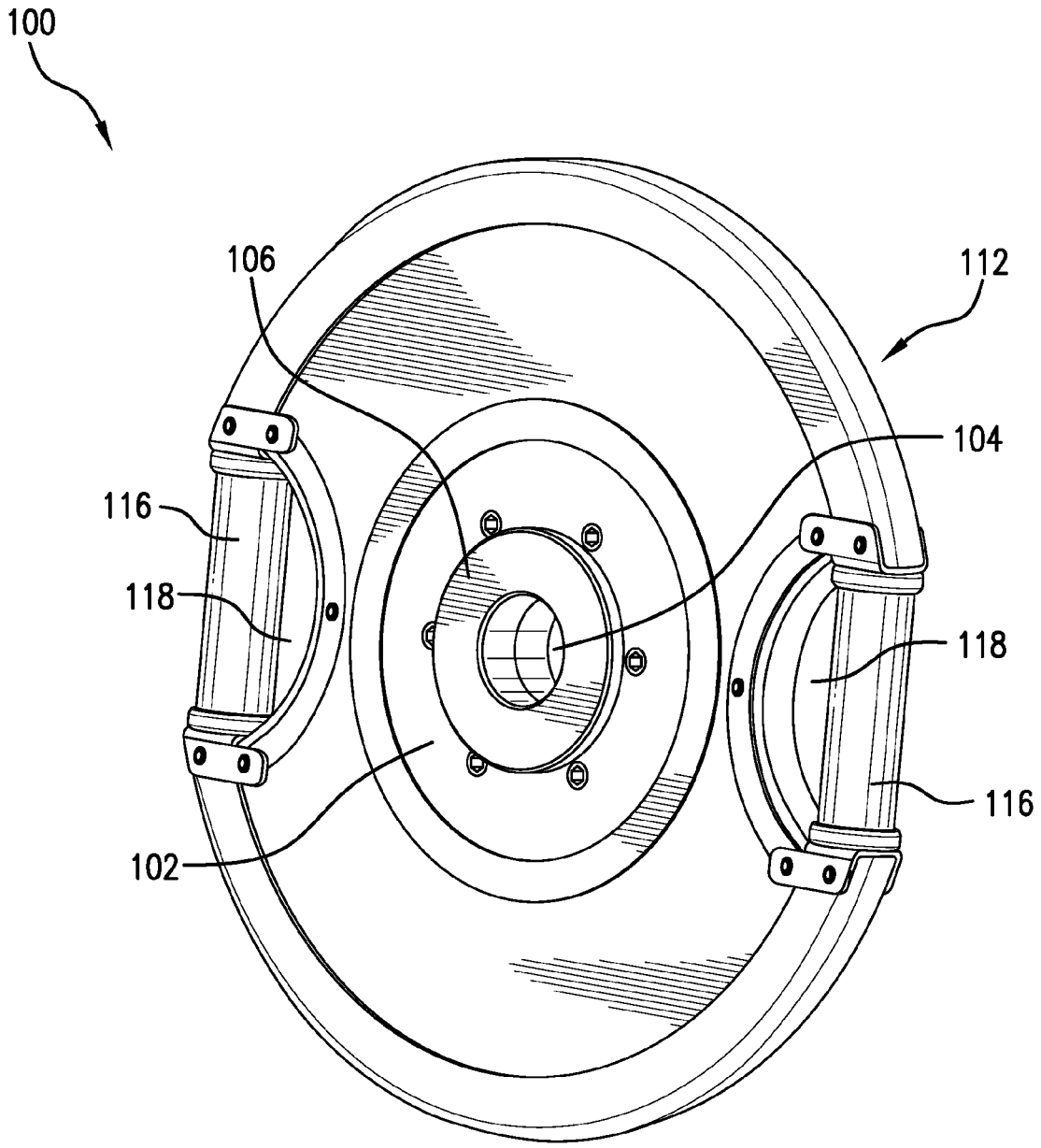
FIG. 1 shows a perspective view of a first embodiment antimicrobial weight plate.

FIG. 1 shows a first embodiment antimicrobial weight plate 100. The first embodiment antimicrobial weight plate 100 comprises a core weight plate 112 in a shape of an annular disk with a center hole 104. The core weight plate 112 is made primarily of cast iron, but in other embodiments comprises other suitable materials such as, stainless steel, aluminum or lead. The core weight plate 112 is encased in urethane, but in other embodiments may be encased in rubber or other suitable jacketing material such as plastic. In yet other embodiments the core weight plate 112 may not have an encasing material.

The first embodiment antimicrobial weight plate 100 further comprises a weight plate hub 102 coupled to the core weight plate 112 about the center hole 104 of the core weight plate 112. The weight plate hub 102 is also annular in shape, with a hub boss 106 around the weight plate center hole 104, which passes through the hub boss 106 as well as the core weight plate 112. In some embodiments, the hub boss 106 is separate from and attached to the weight plate hub 102. The weight plate hub 102 is forged, stamped or otherwise machined. This allows the hub boss 106 to be made with closer tolerances and more suitable materials for accommodating a barbell bar, allowing for a sliding fit that would be difficult to achieve if the contact with the barbell were cast iron or rubber. In the first embodiment 100, the weight plate hub 102 is made of stainless steel, but in other embodiments may be made of other suitable material. The weight plate hub 102 (including the hub boss 106) is wider than the core weight plate 112 and wider than the weight plate handles 116. This ensures that the weight plate handles 116 will not contact the weight plate handles 116 of an adjacent first embodiment antimicrobial weight plate 100 mounted on a bar and will ensure that there are sufficient gaps between the weight plate handles 116 on adjacent weight plates mounted on a bar so that users can insert their fingers into the gap and grasp the weight plate handles 116 of one of the first embodiment antimicrobial weight plates 100. This also ensures that a user can grasp the weight plate handles 116 when the first embodiment antimicrobial weight plate 100 is laying on a floor or other surface, resting on the hub boss 106.

Figure 2:
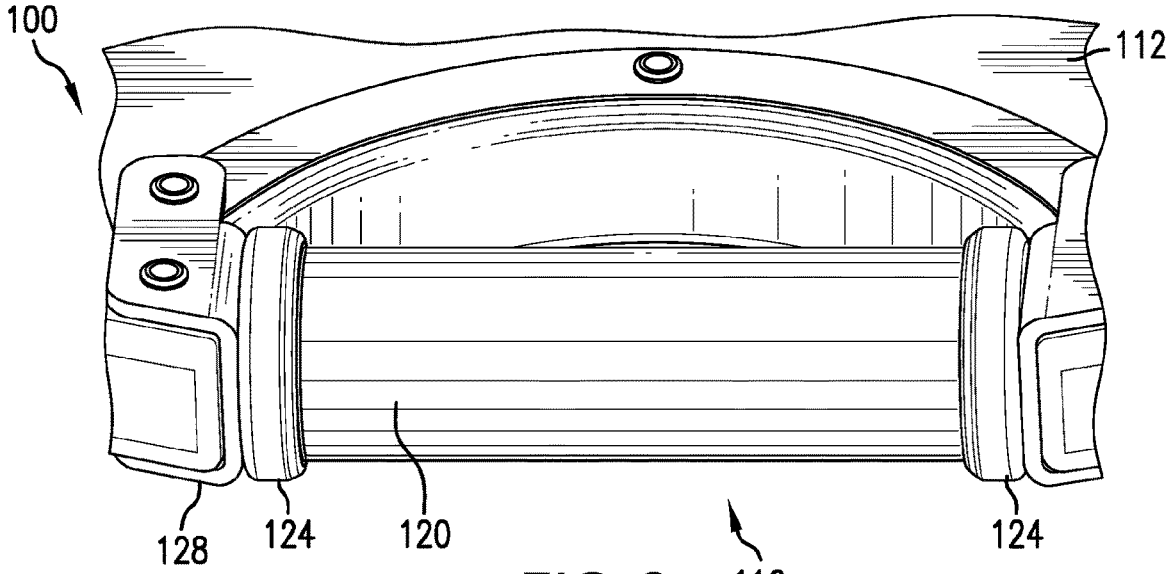
FIG. 2 shows a close-up perspective view of the weight plate handles of the first embodiment antimicrobial weight plate.
Figure 3:
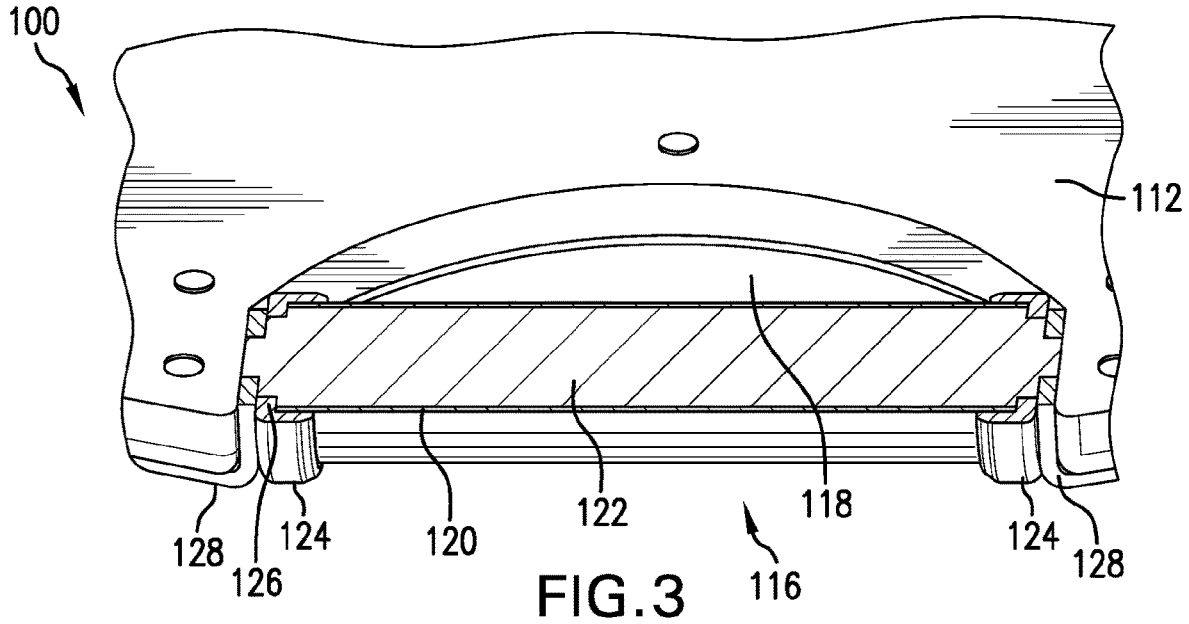
FIG. 3 shows a cut-away close-up perspective view of the weight plate handles of the first embodiment antimicrobial weight plate.

The first embodiment antimicrobial weight plate 100 has two handles 116. FIG. 2 shows a close-up perspective view of the weight plate handles 116 and FIG. 3 shows a cut-away close-up perspective view of the weight plate handles 116. In other embodiments, the antimicrobial weight plate may have only one weight plate handle 116 or may have more than two handles 116. Each of the weight plate handles 116 in the first embodiment antimicrobial weight plate 100 is coupled to the core weight plate 112 in a recess 118 in the circumferential edge of the core weight plate 112. In the first embodiment, each recess 118 has and a rectangular cut-out portion closest the circumferential edge of the core weight plate 112 and an adjacent arcuate cut-out portion further in toward the weight plate center hole 104. The weight plate handle 116 is positioned within the rectangular cut-out portion of the weight plate recess 118, with the arcuate cut-out portion large enough to accommodate a user's fingers when grasping the weight plate handles 116.

The weight plate handles 116 each have an outer grip surface 120 wrapped around a handle core 122. In the first embodiment antimicrobial weight plate 100, the antimicrobial grip surface 120 is knurled, but in other embodiments may have a smooth or other suitable surface finish. The antimicrobial grip surface 120 is formed from an antimicrobial copper alloy, preferably a cuprous nickel alloy containing approximately 91% copper and 9% nickel (marketed as CuVerro® V). The 9% nickel is about the minimum needed for support knurling. Copper kills more than 99.9% of bacteria within 2 hours of exposure and continues killing more than 99.9% even after repeated contamination. Testing has demonstrated copper's effectiveness against such viruses as *Staphylococcus aureus, Enterobacter aerogenes, Escherichia coli* 0157:H7, *Pseudomonas aeruginosa* and methicillin-resistant *Staphylococcus aureus* (MSRA). Copper, however, is a soft metal that cannot withstand the forces that come to bear when strength-training forces are applied, but the cuprous nickel alloy provides the requisite strength. The preferred cuprous nickel alloy described above does not tarnish, and thereby maintains an attractive appearance as well as an effective microbe-killing functionality. The cuprous nickel alloy also provides a positive grip for human hands. In other embodiments, the antimicrobial copper alloy may comprise other ratios of copper and nickel, with concentrations of copper as low as 62% without significant diminishing of the antimicrobial properties.

In the first embodiment antimicrobial weight plate 100, the handle core 122 is formed from steel in a solid cylinder with a 1.25 inch outer diameter. The antimicrobial grip surface 120 has a 1.375 inch (35 mm) outer diameter ("O.D.") and a 1.250 inch (31.75 mm) internal diameter ("I.D.) and is slid over the handle core 122. Near each end of the handle core 122, a first portion has been turned down to 1 inch O.D., then a second portion at the end that has been turned down to 0.5 inch O.D. In other embodiments, other suitable materials may be used for the handle core 122, such as stainless steel. In other embodiments, the handle core 122 and antimicrobial grip surface 120 may have different dimensions.

Each weight plate handle 116 has a pair of handle collars 124, annular in shape and positioned over the ends of the handle core 122 and antimicrobial grip surface 120 with a sliding fit. Copper cannot be welded to steel. The handle collars 124 are preferably formed from antimicrobial brass or copper, and more preferably from the same alloy as the antimicrobial grip surface 120. The collars have respective axially-inward facing collar flange portions 126 which are sized to circumscribe the first portion near the of the handle core 122. The handle collars 124 are slid axially inward over the handle core 122 until the collar flange portions 126 circumscribe the end regions of the antimicrobial grip surface 120. The collar flange portions 126 are structured to be diametrically reduced, as by crimping or similar methodology, to securely press fit the collar (and the relatively soft cuprous nickel underlying the flange portions) against the handle core 122, resulting in an antimicrobial handle that resists bending when in use. Those skilled in the art will recognize that means other than press fitting the handle collars 124 on the handle core 122 could be used (e.g., glue). Those skilled in the art will also recognize that the handle core 122 could be tubular rather than solid steel. Further, a tubular handle core 122 can alternatively be flared outward to secure the antimicrobial grip surface 120 against axial movement within the outwardly flared ends.

The first embodiment antimicrobial weight plate 100 has four handle brackets 128, two for each weight plate handle 116. Each handle bracket 128 has a hole configured for allowing insertion of the second portion at one of the ends of the handle core 122. The handle brackets 128 are coupled to the core weight plate 112 with fasteners such as rivets or threaded screws. The handle brackets 128 are coupled to the core weight plate 112 so that each weight plate handle 116 is positioned in its recess 118 on the circumferential edge of the core weight plate 112.

In addition, each antimicrobial grip surface 120 can be permitted to rotate about a central axis of the handle core 122 in order to reduce or eliminate any rotational handle torque otherwise experienced by a user as the weight plate handles 116 are gripped. Rotational movement can be permitted, for example, by placing the handle core 122 within a steel tube that forms a substrate for the antimicrobial grip surface, providing one or more bearings or bearing surfaces between the steel tube and bar to permit substantially friction-free rotation of the steel tube (and antimicrobial copper tube affixed thereabout) about the handle core 122.

The first embodiment antimicrobial weight plate 100 is typically a larger weight, 25 lbs. or more. The cost making the weight plate handles 116 out of antimicrobial copper alloy and attaching them is offset by the cost savings of not making entire the entire core weight plate 112 with antimicrobial copper alloy. A first embodiment antimicrobial weight plate 100 of 25 lb. size would typically be 1.12 inches thick and 17.88 inches in diameter with a center hole 104 that is 2 inches in diameter. A first embodiment antimicrobial weight plate 100 of 45 lb. size would typically be have the same dimensions as the 25 lb. plate, but the thickness increased to 1.50 inches.

Second Representative Embodiment

Figure 4:
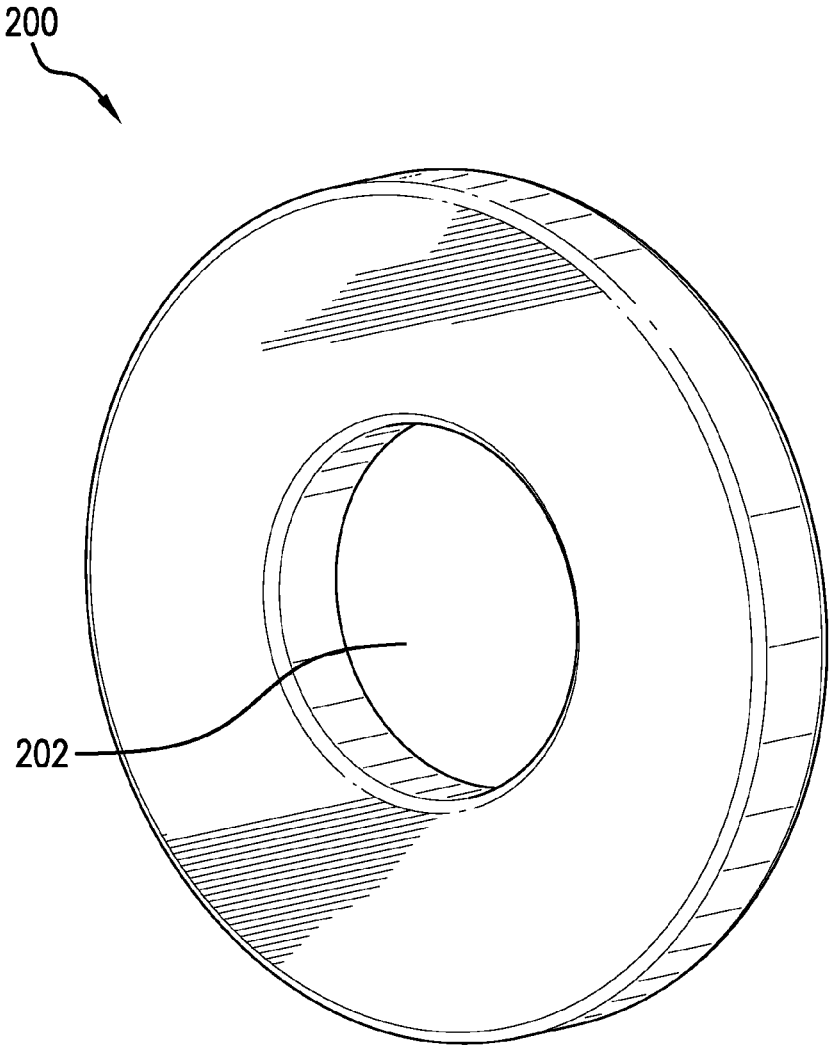
FIG. 4 shows a perspective view of a second embodiment antimicrobial weight plate.

FIG. 4 shows a second embodiment antimicrobial weight plate 200. The second embodiment antimicrobial weight plate 200 is in a shape of an annular disk with a center hole 202 and consists of an antimicrobial copper alloy, similar to ones disclosed in the description of the first embodiment antimicrobial weight plate 100. The second embodiment antimicrobial weight plate 200 is typically a small-sized weight, 5 lbs. or less. Making a second embodiment antimicrobial weight plate 200 larger would not be cost effective since it is entirely antimicrobial copper alloy. A second embodiment antimicrobial weight plate 200 of 5 lb. size would typically be 0.60 inches thick and 6.13 inches in diameter with a center hole 202 that is 2 inches in diameter. A second embodiment antimicrobial weight plate 200 of 2.5 lb. size would typically be 0.560 inches thick and 4.9 inches in diameter with a center hole 202 that is 2 inches in diameter.

Third Representative Embodiment

Figure 5:
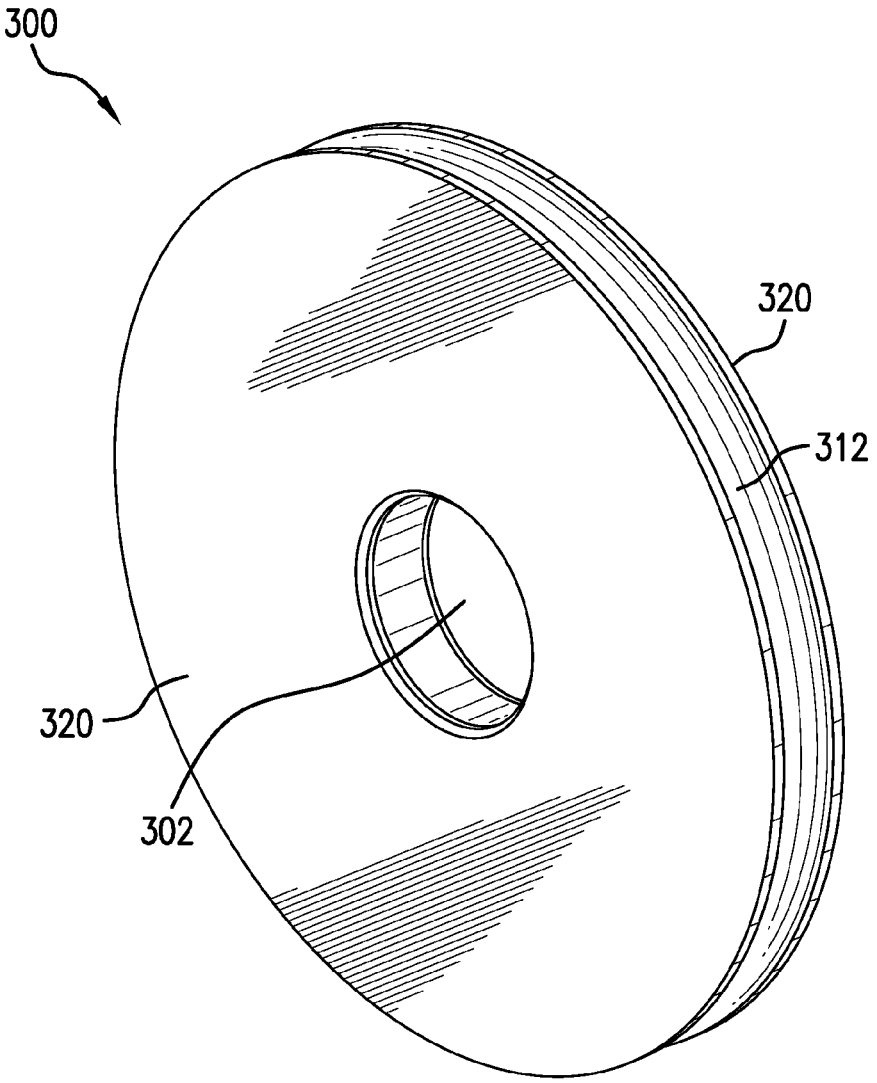
FIG. 5 shows a perspective view of a third embodiment antimicrobial weight plate.

FIG. 5 shows a third embodiment antimicrobial weight plate 300. The third embodiment antimicrobial weight plate 300 comprises a core weight plate 312 sandwiched between two antimicrobial weight plate surfaces 320. The antimicrobial weight plate surfaces 320 each are in a shape of an annular disk with a center hole 302 and comprise an antimicrobial copper alloy, similar to ones disclosed in the description of the first embodiment antimicrobial weight plate 100. The core weight plate 312 is in a shape of an annular disk, with a center hole 302 and comprises similar materials as the core weight plate 112 in the first embodiment antimicrobial weight plate 100. The core weight plate 312 has a diameter smaller than diameters of the antimicrobial weight plate surfaces 320. The antimicrobial weight plate surfaces 320 are bonded to the core weight plate 312 with epoxy, but in other embodiments may be coupled by rivets or other suitable mechanisms. The third embodiment antimicrobial weight plate 300 is typically a mid-sized weight, less than 25 lbs. but more than 5 lbs. The cost bonding the antimicrobial weight plate surfaces 320 to the core weight plate 312 is offset by the cost savings of not making the entire third embodiment antimicrobial weight plate 300 with an antimicrobial copper alloy. A third embodiment antimicrobial weight plate 300 of 10 lb. size would typically be 0.765 inches thick and 7.94 inches in diameter with a center hole 302 that is 2 inches in diameter.

Fourth Representative Embodiment

Figure 6:
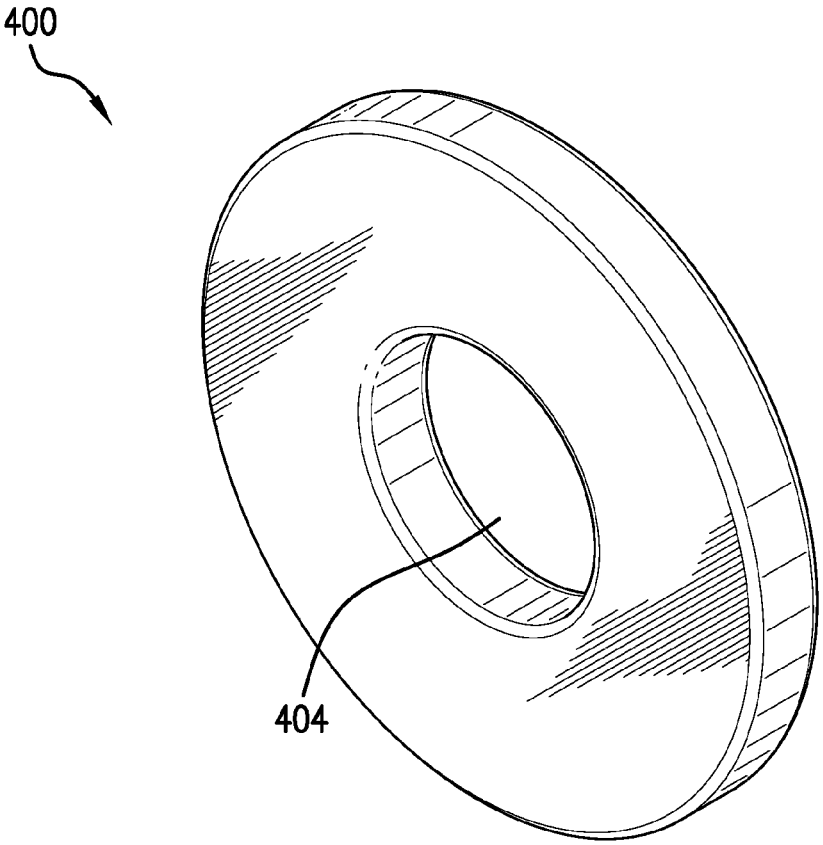
FIG. 6 shows a fourth embodiment antimicrobial weight plate 400.

FIG. 6 shows a fourth embodiment antimicrobial weight plate 400. The fourth embodiment antimicrobial weight plate 400 comprises a core weight plate in a shape of an annular disk with a center hole 404, the core weight plate coated with a coating of an antimicrobial copper alloy, similar to the alloys disclosed in the description of the first embodiment antimicrobial weight plate 100. The core weight plate is made of steel, but in other embodiments is made of other suitable materials such as cast iron, stainless steel, aluminum or lead. The coating of antimicrobial copper alloy is deposited on the core weight plate in a multi-pass thermal spray process, such as described in US 2016/0138150 A1. The coating is done with multiple passes of the antimicrobial copper alloy, so as not to create excess heat stress on the substrate material and to allow for a uniform coat. After the thermally sprayed coating is applied, it is mechanically abraded to reduce the depth of cavities in the coating and to give an exposed abraded metal surface in regions between the cavities. The fourth embodiment antimicrobial weight plate 400 receives a manual abrasion finish, resulting in the coating having a thickness of 0.004 to 0.006 inches.

The fourth embodiment antimicrobial weight plate 400 is typically a small-sized weight, 5 lbs. or less, but may also be a medium-sized weight up to 25 lbs. Fourth embodiment antimicrobial weight plates 400 at 25 lbs. and above may be cost effective and durable, but handles become desirable at 25 lbs. or more, so the first embodiment antimicrobial weight plate 100 is a better choice in that weight range. A fourth embodiment antimicrobial weight plate 400 of 5 lb. size would typically be 0.60 inches thick and 6.13 inches in diameter with a center hole 2 inches in diameter. A second embodiment antimicrobial weight plate 200 of 2.5 lb. size would typically be 0.560 inches thick and 4.9 inches in diameter with a center hole 2 inches in diameter.

What is claimed is:

1. An antimicrobial weight set comprising:

a first antimicrobial weight plate having a first core weight plate in a shape of an annular disk with a center hole and with one or more recesses in a circumferential edge of the first core weight plate, the first antimicrobial weight plate having one or more weight plate handles, each of the one or more weight plate handles coupled to the first core weight plate in one of the one or more recesses, each of the one or more weight plate handles having an antimicrobial grip surface around a handle core, wherein the antimicrobial grip surfaces comprises a first antimicrobial copper alloy;

a second antimicrobial weight plate comprising a second core weight plate in a shape of an annular disk and a coating of a second antimicrobial copper alloy thermally sprayed on to the second core weight plate; and a third antimicrobial weight plate with two antimicrobial weight plate surfaces, each of the two antimicrobial weight plate surfaces consisting of a third antimicrobial copper alloy in a shape of an annular disk, the third antimicrobial weight plate having a third core weight plate in a shape of an annular disk coupled to and between the two antimicrobial weight plate surfaces.

2. The antimicrobial weight set of claim 1 wherein the first antimicrobial copper alloy, the second antimicrobial copper alloy, and the third antimicrobial copper alloy all comprise a cuprous nickel alloy.

* * * * *